United States Patent [19]

Shuert

[11] Patent Number: 4,606,278

[45] Date of Patent: Aug. 19, 1986

[54] TWIN SHEET PALLET

[76] Inventor: Lyle H. Shuert, 817 Fieldstone, Rochester, Mich. 48063

[21] Appl. No.: 655,870

[22] Filed: Sep. 28, 1984

[51] Int. Cl.[4] ..... B65D 19/18

[52] U.S. Cl. ..... 108/51.1; 108/53.3; 108/901

[58] Field of Search ..... 108/51.1, 52.1, 53.3, 108/57.1, 901; 206/386, 595, 596, 598

[56] References Cited

U.S. PATENT DOCUMENTS

| | | | |
|---|---|---|---|
| 3,228,358 | 1/1966 | Sepe et al. | 108/901 X |
| 3,330,228 | 7/1967 | Donnelly | 108/51.1 |
| 3,611,952 | 10/1971 | Hoffman | 108/901 X |
| 3,636,888 | 1/1972 | Angelbeck, Jr. | 108/901 X |
| 4,428,306 | 1/1984 | Dresen et al. | 108/901 X |

FOREIGN PATENT DOCUMENTS

| | | | |
|---|---|---|---|
| 805979 | 2/1969 | Canada | 108/901 |
| 2043832 | 11/1971 | Fed. Rep. of Germany | 108/53.3 |
| WO83/00474 | 2/1983 | PCT Int'l Appl. | 108/53.3 |

*Primary Examiner*—William E. Lyddane
*Assistant Examiner*—Peter R. Brown
*Attorney, Agent, or Firm*—Krass and Young

[57] ABSTRACT

A twin sheet pallet constructed by forming a lower polygonal plastic sheet to define an upwardly opening U-shaped groove around its periphery; forming an upper polygonal plastic sheet to define a plurality of circumferentially spaced upwardly opening U-shaped protrusions extending downwardly from the general plane of the sheet and sized to nest in the groove of the upper sheet; positioning the upper sheet over the lower sheet with the protrusions on the upper sheet nested at circumferentially spaced locations in the groove of the lower sheet; fusing the upper and lower sheets together to form double thickness U-shaped wall structures at the interfaces of the protrusions and the groove; and cutting aligned horizontally extending slots in the opposite sides of the U-shaped structures to allow entry of the forks of a forklift truck.

4 Claims, 6 Drawing Figures

TWIN SHEET PALLET

DESCRIPTION

BACKGROUND OF THE INVENTION

This invention relates to shipping and storage pallets and more particularly to plastic pallets embodying a twin sheet construction.

Pallets have traditionally been formed of wood. Wood pallets, however, have many disadvantages. For example, they are subject to breakage and thus are not reusable over an extended period of time. Wood pallets also take up a considerable amount of valuable floor space in the warehouse when they are not in use. In an effort to solve some of the problems associated with wood pallets, plastic pallets have been employed with some degree of success. In one generally successfull form of plastic pallet design, a twin sheet construction has been used in which upper and lower plastic sheets are formed in separate molding operations and the two sheets are then selectively fused or knitted together in a suitable press to form reinforced double wall structure. Even these twin sheet plastic pallets have drawbacks however. Specifically, their under surfaces tend to be irregular so that movement of the pallet over irregular transfer surfaces and over various transfer devices such as conveyors is difficult and sometimes impossible. Further, the prior art twin sheet pallets have tended to creep or sag after a period of time. Further, the prior art twin sheet pallets fail to make provision to preclude tipping of the pallet off of the forks of a forklift truck in the presence of an unbalanced load on the pallet.

SUMMARY OF THE INVENTION

This invention provides a twin sheet plastic pallet which provides a continuous lower footprint to facilitate movement of the pallet over irregular transfer surfaces. The invention pallet is also extremely resistant to sagging or warping, even over extended periods of use. The invention pallet also provides lower straps which pass beneath the inserted forks of a forklift truck to preclude tipping of the pallet even in the presence of an unbalanced load on the pallet.

The invention plastic pallet includes a lower polygonal plastic sheet defining an upwardly opening U-shaped groove around its periphery; and an upper polygonal plastic sheet defining a plurality of circumferentially spaced upwardly opening U-shaped protrusions extending downwardly from the general plane of the sheet and sized to nest within the groove of the lower sheet. In manufacture, the upper sheet is positioned over the lower sheet with the protrusions positioned at circumferentially spaced locations in the groove and the sheets are thereafter fused together in a compression molding process to form double thickness U-shaped wall structures at the interfaces of the protrusions and the groove, whereafter aligned horizontally extending slots are cut or routed in the opposite sides of the U-shaped structures to allow entry of the forks of a forklift truck. This structure provides a continuous lower footprint for the pallet to facilitate movement of the pallet over transfer surfaces, and provides straps to capture the lower faces of the forks of the forklift truck to preclude tipping of the pallet in response to unbalanced loads. The invention structure is also extremely strong and extremely resistant to sagging or warping, even over extended periods of use.

According to a further aspect of the invention, the lower sheet includes a raised central portion within the groove which defines a hollow central area beneath the pallet into which the inner ends of the forks of the forklift truck may extend after passing through the aligned slots in the opposite sides of the U-shaped double thickness wall structures.

According to another aspect of the invention, the central portion of the upper sheet within the protrusions is generally planar and generally at the level of the outer upper edges of the protrusions; the protusions have a depth at their outer walls generally corresponding to the outer wall depth of the groove; and the raised central portion of the lower sheet is below the plane of the outer upper edge of the groove so that, when the protrusions are nested in the groove, the central portions of the sheets form a spaced double wall construction. This spaced double wall construction adds significantly to the overall strength of the pallet and adds to its rackability.

In the disclosed embodiment of the invention, the upper and lower sheets are rectangular and two peripherally spaced protrusions are provided along each side of the upper sheet so as to provide two sets of aligned slots along each side edge of the pallet for passage of the two forks of the forklift truck.

DETAILED DESCRIPTION OF THE PREFERRED EMBODIMENT

Figure 1:
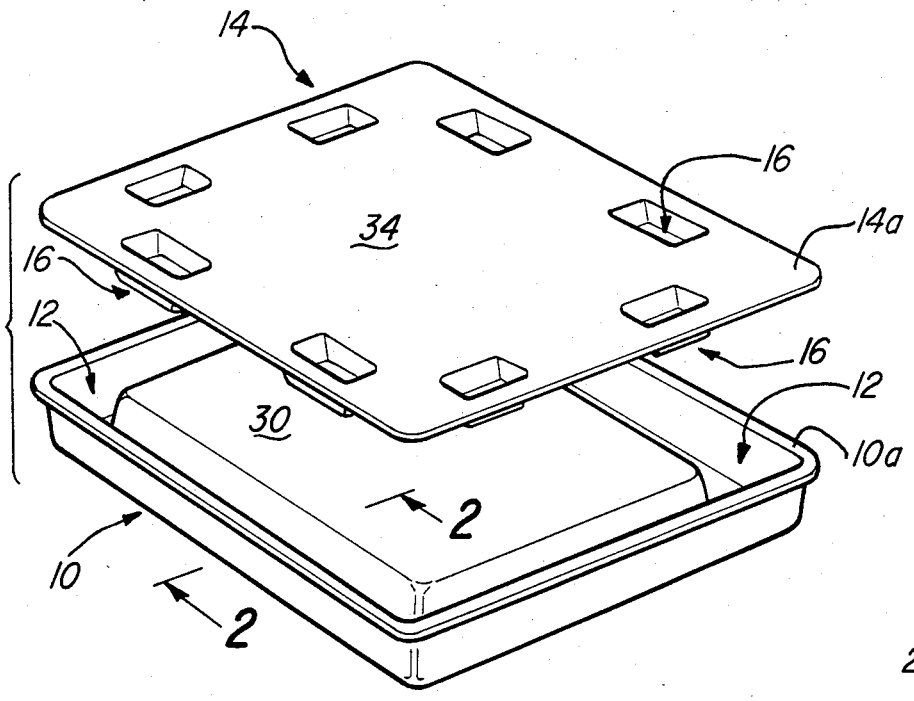
FIG. 1 is a perspective schematic view of the upper and lower sheets of the invention twin sheet pallet prior to being fused together to form the finished pallet.
Figure 2:
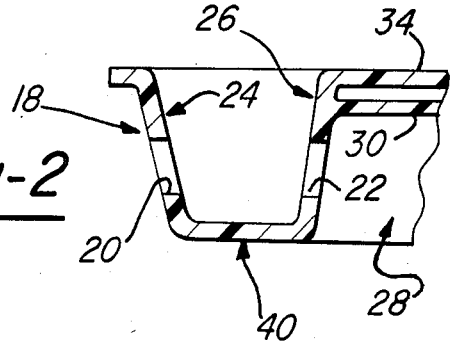
FIG. 2 is a fragmentary cross-sectional view of the schematic pallet of FIG. 1.
Figure 3:
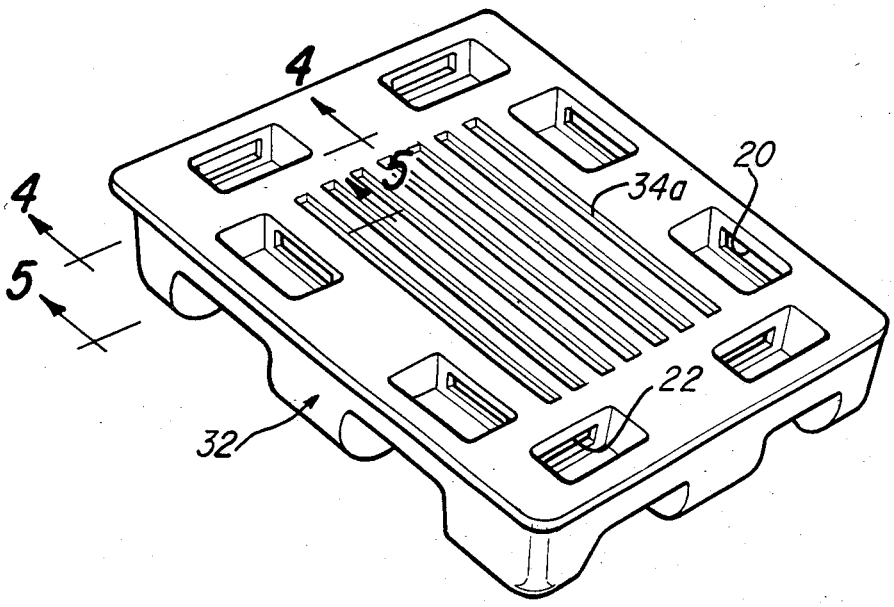
FIG. 3 is a perspective view of a commercial embodiment of the invention pallet.
Figure 4:
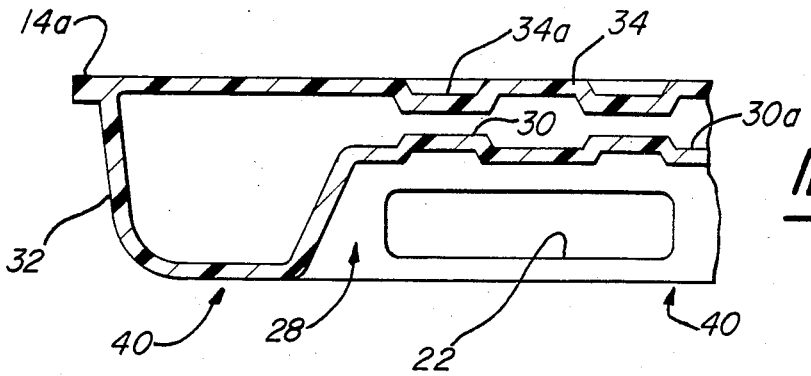
FIGS. 4 and 5 are fragmentary cross-sectional views taken respectively on lines 4—4 and 5—5 of FIG. 3.
Figure 5:
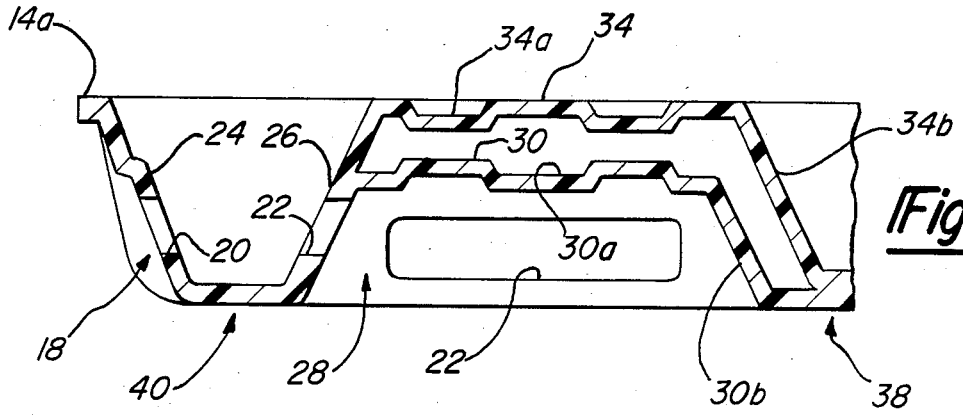

The basic inventive concepts of the invention pallet are schematically disclosed in FIGS. 1 and 2. Broadly, a lower sheet 10 is suitably molded to provide an upwardly opening generally U-shaped peripheral groove 12 extending around its entire periphery; an upper sheet 14 is suitably molded to provide a plurality of circumferentially spaced upwardly opening U-shaped protrusions 16 extending downwardly from the general plane of the sheet and sized to nest within the groove 12 of the lower sheet; the upper sheet is positioned immediately over the lower sheet with the protrusion 16 nested in groove 12 at circumferentially spaced locations around the groove with the sides of the protrusions contiguous with the sides of the groove, the bottoms of the protrusions contiguous with the bottom of the groove, and the peripheral edge **14*a* of the upper sheet immediately overlying and contiguous with the peripheral edge 10*a* of the lower sheet; and the sheets are fused or knitted together to form double thickness U-shaped wall structures 18 at the interfaces of the protrusions 16 and groove 12. Horizontally extending aligned slots 20 and 22 are then formed respectively in the opposite sidewalls 24 and 26 of U-shaped structures 18 to allow entry of the forks of a forklift truck. The forks after passing through aligned openings 20 and 22 pass into a hollow central area 28 defined beneath the raised central portion 30 of the lower sheet. Sheets 10 and 14** may be molded in a vacuum forming process and may be formed of an organic polymeric material such as polyethylene, and the process whereby the sheets are knitted together to form the pallet may comprise a compression molding proces.

Figure 6:
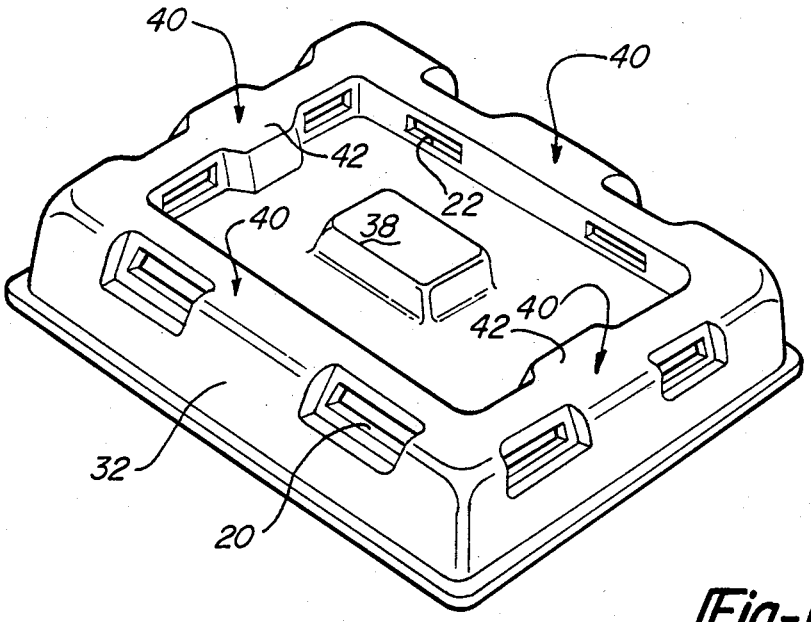
FIG. 6 is a perspective upside down view of the pallet of FIG. 3.

A specific commercial embodiment of the invention twin sheet pallet is illustrated in FIGS. 3–6. With reference now to the finished pallet of FIGS. 3–6, sheets 10 and 14 are initially formed so that, when fused together, the double thickness outer wall 24 of U-shaped structures 18 is inset with respect to the single thickness outer wall 32 of the pallet between structures 18 so that outer slots 20, as best seen in FIG. 6, are inset and protected with respect to the outer wall of the pallet. Central portion 34 of upper sheet 14 is generally flush with peripheral edge 14*a* and the raised central portion 30 of lower skin 10 is spaced below the level of the peripheral edge 10*a* of lower sheet 10 so that, when the sheets are positioned together to form the finished pallet, central portion 30 of lower sheet 10 and central portion 34 of upper sheet 14 form a spaced double wall structure. Ribs 30*a* and 34*a* in central portions 30 and 34 provide stiffness to the central area of the pallet and the central pallet area is further stiffened by a centrally downwardly projecting protrusion 30*b* in lower sheet 10 coacting and knitted together with a centrally downwardly projecting protrusion 34*b* in upper sheet 14 to form a central leg or foot 38. Foot 38 is at the same level as the continuous circumferential footprint 40 provided by the under surface of groove 12 and coacts with that footprint to provide firm, flat, sturdy footing for the pallet while not interfering with the inward intrusion of the forks of the forklift truck passing through any of the aligned slots 20, 22. The upper and lower sheets are also configured to provide inwardly projecting protrusions 42, in general alignment with foot 38, to further strengthen and stabilize the pallet. It will be understood that the upper and lower sheets are further convoluted, configured, internested, and knitted together, particularly in the corner areas of the pallet and the peripheral areas between adjacent U-shaped Figures 18, to provide further strength and rigidity for the pallet.

The invention pallet will be seen to provide many important advantages. Specifically, the invention construction provides a continuous peripheral footprint on the bottom of the pallet so that the pallet can pass easily over various and irregular transfer surfaces and transfer devices such, for example, as conveyors. The invention construction also provides a rigid lower strap passing beneath the inserted forks of a forklift truck so that the pallet, even if unevenly loaded, will not tend to tip off of the forks as the pallet is lifted and transported by the forks. The invention construction also provides a very stiff and rigid pallet which resists bowing or warpage even over extended periods of use. The invention pallet is also extremely simple in construction and therefore relatively inexpensive to produce and yet is extremely sturdy so as to provide an extremely long useful life.

Although a preferred embodiment of the invention has been illustrated and described it will be apparent that various changes may be made in the disclosed embodiment without departing from the scope or spirit of the invention.

I claim:

1. A twin sheet plastic sheet comprising:

(a) a lower polygonal plastic sheet defining an upwardly opening continuous U-shaped substantially constant depth groove extending in a closed loop around the total periphery of said lower sheet to define a continuous circumferential footprint on the undersurface of said lower sheet;

(b) an upper polygonal plastic sheet defining a plurality of circumferentially spaced upwardly opening U-shaped protrusions extending downwardly from the general plane of the sheet and sized to nest within the groove of the lower sheet, whereby said upper sheet is positioned over said lower sheet with said protrusions positioned at circumferentially spaced locations in said groove and said sheets are fused together to form double thickness U-shaped wall structures at the interfaces of the protrusions and the groove and a continuous circumferential footprint beneath said pallet to facilitate movement of said pallet over various transfer surfaces and devices; and (c) aligned horizontally extending slots in the opposite sides of said U-shaped wall structures to allow passing of the forks of a forklift truck.

2. A twin sheet pallet according to claim 1 wherein:

(d) said lower sheet includes a raised central portion within said groove defining a hollow central area beneath said pallet into which the inner ends of the forks of the forklift truck may extend after passing through the aligned slots in the opposite walls of the double thickness U-shaped wall structures.

3. A twin sheet plastic pallet according to claim 2 wherein:

(e) the central portion of said upper sheet within said protrusions is generally planar and generally at the level of the peripheral edges of said upper sheet;

(f) said protrusions have a depth at their outer walls generally corresponding to the outer wall depth of said groove; and (g) said raised central portion of said lower sheet is below the plane of the peripheral edge of said lower sheet so that, when said protrusions are nested in said groove, the central portions of said sheets form a spaced, double wall construction.

4. A twin sheet pallet according to claim 3 wherein:

(h) said upper and lower sheets are rectangular and two peripherally spaced protrusions are provided along each side of said upper sheet so as to provide two sets of aligned slots along each side edge of the finished pallet for passage of the two forks of a forklift truck.

* * * * *